US010597959B2

(12) United States Patent
Rao et al.

(10) Patent No.: US 10,597,959 B2
(45) Date of Patent: Mar. 24, 2020

(54) METHODS FOR ENHANCING CUTTINGS TRANSPORT AND HOLE CLEANING IN OIL AND GAS WELLS

(71) Applicant: ExxonMobil Upstream Research Company, Spring, TX (US)

(72) Inventors: Sai S. Rao, Spring, TX (US); Kaustubh S. Kulkarni, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/266,885

(22) Filed: Feb. 4, 2019

(65) Prior Publication Data

US 2019/0323328 A1 Oct. 24, 2019

Related U.S. Application Data

(60) Provisional application No. 62/659,818, filed on Apr. 19, 2018.

(51) Int. Cl.

| | |
|---|---|
| ***E21B 21/08*** | (2006.01) |
| ***E21B 33/138*** | (2006.01) |
| *E21B 43/16* | (2006.01) |

(52) U.S. Cl.

CPC ..... *E21B 21/08* (2013.01); *E21B 33/138* (2013.01); *E21B 43/16* (2013.01)

(58) Field of Classification Search

None

See application file for complete search history.

(56) References Cited

U.S. PATENT DOCUMENTS 9,367,653 B2 * 6/2016 Madasu ..... E21B 43/267

OTHER PUBLICATIONS

Clark et al.; "A Mechanistic Model for Cuttings Transport"; Society of Petroleum Engineers, Inc.; SPE 28306; 1994; p. 139-153. (Year: 1994).*

(Continued)

*Primary Examiner* — Andrew Sue-Ako

(74) *Attorney, Agent, or Firm* — ExxonMobil Upstream Research Company—Law Department

(57) ABSTRACT

Methods for enhancing transport rate of particles of size $D_m$ in a cuttings bed within an annulus of a wellbore during drilling operations. One method comprises estimating, with a computer, a current particle size distribution (PSD) of a particle bed including particles of size $D_m$ within a measured depth (MD) range of the wellbore; calculating, with the computer, a target PSD of the MD range using a using a one-dimensional transient model incorporating a particle transport model; determining, with the computer, a pumping PSD to achieve the target PSD within the MD range; and adding the pumping PSD to a drilling fluid flowing within the annulus, thereby enhancing the transport rate of particles of size $D_m$ within the MD range. The particle transport model may be a surface-based transport model.

20 Claims, 9 Drawing Sheets

(56) References Cited

OTHER PUBLICATIONS

Li et al.; "Numerical Modelling of Cuttings Transport in Horizontal Wells Using Conventional Drilling Fluids"; Journal of Canadian Petroleum Technology; vol. 46, No. 7; Jul. 2007; p. 9-15. (Year: 2007).*

Kuhnle, R. A., et al. (2013), "Sand transport over an Immobile Gravel Substrate", Journal of Hydraulic Engineering, vol. 139, Issue 2, pp. 167-176.

Meyer-Peter, E. et al. (1948) "Formulas for Bed Load Transport", Proc. 2rd IAHR Congr., pp. 39-64.

Parker, G. (1990) "Surface-based bedload transport relation for gravel rivers", Journal of Hydraulic Engineering, vol. 28, Issue 4, pp. 417-436.

Parker, G. et al. (1993) "Sediment feed and recirculating flumes: A fundamental difference", Journal of Hydraulic Engineering, vol. 119, Issue 11, pp. 1192-1204.

Proffitt, G. T. et al. (1983) "Transport of Non-Uniform Sediments", Journal of Hydraulic Research, vol. 21, Issue 1, pp. 33-43.

Wilcock et al. (Feb. 2003) "Surface-Based Transport Model for Mixed-Size Sediment", Journal of Hydraulic Engineering, vol. 129, Issue 2, pp. 120-128.

* cited by examiner

METHODS FOR ENHANCING CUTTINGS TRANSPORT AND HOLE CLEANING IN OIL AND GAS WELLS

CROSS REFERENCE TO RELATED APPLICATION

This application claims the priority and benefit of U.S. Provisional Application Ser. No. 62/659,818, filed Apr. 19, 2018, the disclosure of which is incorporated herein by reference in its entirety.

BACKGROUND

Field of Disclosure

The present disclosure relates to oil and gas drilling operations and, more particularly, methods for enhancing the transport of cuttings and cavings generated by hydrocarbon drilling operations in order to prevent disruption and improve efficiency.

Description of Related Art

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as an admission of prior art.

In the oil and gas industry, one common method of drilling wells involves forming a wellbore by inserting a drill string into the earth, which comprises a drill bit that is rotated to break the rock in the earth as the drill string advances. Drill bits are typically attached to a drill pipe that transmits the rotation and force driving the drill bit, as well as drilling fluid. As the drill bit rotates and advances within the earth, it generates small rock fragments and particles known as "cuttings." The drilling fluid being pumped down the drill pipe is injected into the wellbore at the drill bit to provide a mechanism for the cuttings to be transported out of the borehole through the annulus—i.e., the space between the drill pipe and the borehole wall. However, cuttings transport is a complex mechanism involving complicated fluid dynamics and varying conditions across the length of the wellbore which, in horizontal or near-horizontal wells, may result in undesirable cuttings accumulations known as "cuttings beds." These incidents are often compounded by wellbore instability, which may generate cave-in or breakout events in which relatively large pieces of rock called "cavings" detach from the borehole wall and obstruct mud flow and exacerbate cuttings beds. These inefficiencies in transport ultimately may lead to a variety of problems, including the drill pipe becoming stuck, increased torque and drag, lower penetration rates, etc.

Cuttings transport has been studied for many years in both vertical and non-vertical wellbore configurations. Computer models exist that attempt to simulate the flow dynamics inside wellbores and optimize drilling parameters that might improve transport, with the ultimate goal of drilling a borehole as fast as possible. However, the mechanics of cuttings transport remains poorly understood as it depends on many factors, including operational parameters such as flow rate and RPM, fluid properties, wellbore size and configuration, particle characteristics, etc.

The present disclosure provides methods for enhancing the transport of cuttings and cavings (collectively referred to as "cuttings transport" or hole cleaning) in a non-vertical wellbore. Such methods may incorporate particle fractional transport rate estimations using a particle transport model within a framework for determining an optimum particle size distribution and mass rate to be injected or generated during drilling operations to enhance cuttings transport. Improving wellbore cleaning—i.e., removal of cuttings and cavings—may enhance wellbore stability and prevent lost returns and breakout events by reducing the possibility of localized pressure spikes within the annulus.

SUMMARY

Exemplary embodiments of the present technical advancement provide methods for enhancing transport rate of particles of size $D_m$ in a cuttings bed within an annulus of a wellbore during drilling operations. One method comprises estimating, with a computer, a current particle size distribution (PSD) of a particle bed including particles of size $D_m$ within a measured depth (MD) range of the wellbore; calculating, with the computer, a target PSD of the MD range using a one-dimensional transient model incorporating a particle transport model; determining, with the computer, a pumping PSD to achieve the target PSD within the MD range; and adding the pumping PSD to a drilling fluid flowing within the annulus, thereby enhancing the transport rate of particles of size $D_m$ within the MD range. In some embodiments, the current PSD may be estimated using a one-dimensional transient model. The particle transport model may be a surface-based transport (SBT) model.

In other embodiments, calculating a target PSD may comprise (a) assuming a target PSD for the MD range; (b) using the one-dimensional transient model to obtain a desired critical shear stress $\tau_{cmdesired}$ for the particles of size $D_m$ within the MD range; obtain a surface shear stress $\tau$ on the particle bed in the MD range; and obtain a current fractional transport rate $T_m$ for the particles of size $D_m$ within the MD range; (c) comparing $T_m$ to a desired fractional transport rate $T_{mdesired}$, and (d) if $T_m$ and $T_{mdesired}$ are within a desired tolerance, adopting, as the target PSD, the assumed target PSD; or, if $T_m$ and $T_{mdesired}$ are not within the desired tolerance, modifying the assumed target PSD and repeating steps (b)-(d). The desired fractional transport rate $T_{mdesired}$ may be determined based on the current fractional transport rate $T_m$ for the particles of size $D_m$ in the MD range. In some embodiments, the desired fractional transport rate $T_{mdesired}$ may be higher than the current fractional transport rate $T_m$.

In yet other embodiments, obtaining the current fractional transport rate $T_m$ may comprise calculating a critical shear stress $\tau_{cm}$ for the particles of size $D_m$ within the MD range; calculating a surface shear stress $\tau$ on the particle bed in the MD range; and using the particle transport model to calculate the current fractional transport rate $T_m$ for the particles of size $D_m$ within the MD range based on $\tau_{cm}$ and $\tau$. Determining a pumping PSD may comprise (a) assuming a pumping PSD; (b) using the one-dimensional transient model to obtain a calculated PSD in the MD range of interest; (c) comparing the calculated PSD to the target PSD; and (c) if the calculated PSD and the target PSD are within a desired tolerance, adopting, as the pumping PSD, the assumed pumping PSD; or, if the calculated PSD and the target PSD are not within desired tolerance, modifying the assumed pumping PSD and repeating steps (b)-(d).

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
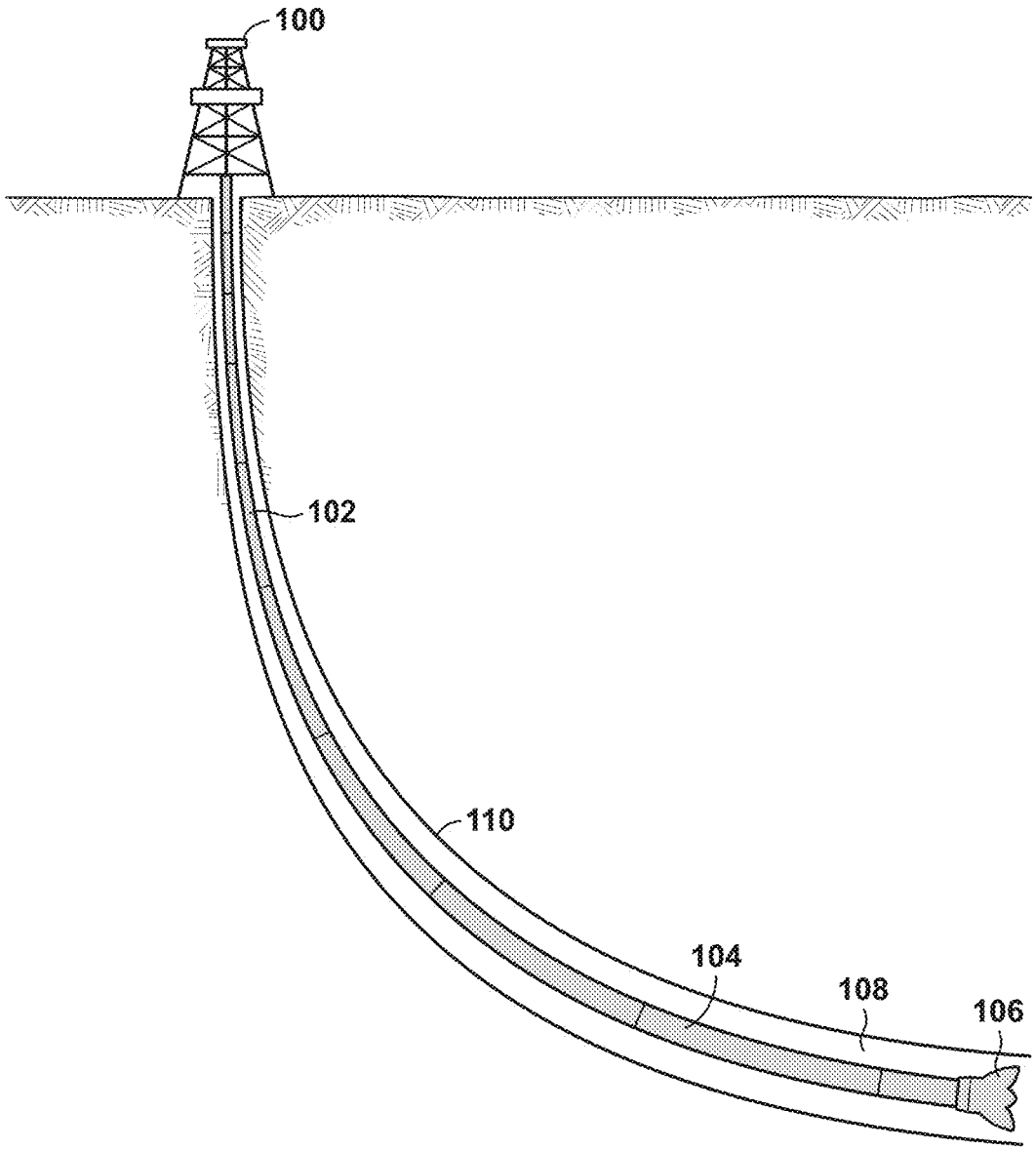
FIG. 1 is a simplified diagram of an exemplary drilling system operating in a wellbore.

It should be noted that the figures are merely examples and no limitations on the scope of the present disclosure are intended thereby. Further, the figures are generally not drawn to scale, but are drafted for purposes of convenience and clarity in illustrating various aspects of the disclosure. Certain features and components therein may be shown exaggerated in scale or in schematic form and some details of conventional elements may not be shown in the interest of clarity and conciseness. When describing a figure, the same reference numerals may be referenced in multiple figures for the sake of simplicity.

DETAILED DESCRIPTION

To promote an understanding of the principles of the disclosure, reference will now be made to the features illustrated in the drawings and no limitation of the scope of the disclosure is hereby intended by specific language. Any alterations and further modifications, and any further applications of the principles of the disclosure as described herein are contemplated as would normally occur to one skilled in the art to which the disclosure relates.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

The terms "approximately," "about," "substantially," and similar terms are intended to have a broad meaning in harmony with the common and accepted usage by those of ordinary skill in the art to which the subject matter of this disclosure pertains. These terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

The term "cuttings" refers to relatively small pieces of rock or other material generated by a drill bit excavating the earth to form a wellbore. Different kinds of drilling bits (e.g., roller cone, PDC, etc.) generate cuttings of various sizes and shapes. Cuttings are irregularly shaped and their size is generally described by a characteristic length. The characteristic length of cuttings is typically between 0.01 and 1 inches.

The term "cavings" refers to pieces of rock detached from the borehole wall but not removed directly by the drill bit during drilling operations. Mechanisms for detachment or formation of cavings include, but are not limited to, wellbore failure and breakout events. Cavings are also irregularly shaped and their size is generally described by a characteristic length. The characteristic length of cavings typically ranges between 0.1 and 4 inches.

The term "cuttings transport" refers to the mechanism by which cuttings and cavings are removed from a wellbore, including by the action of a drilling fluid being pumped down the wellbore through a drill pipe and flowing out of the wellbore through the annular space formed between the rotating or non-rotating drill pipe and the borehole wall or casing/liner (i.e., the annulus).

The terms "drilling fluid or "mud" refer to fluid pumped down a wellbore through a drill pipe to aid in drilling operations and hole cleaning, including by transporting cuttings or cavings generated during such operations out of the wellbore. Drilling fluids may be water-based, oil-based, foam, or gaseous. Drilling fluid may also contain weighing agents (e.g., barite) and other solid or liquid additives (e.g., friction reduction, fluid loss control agents, etc.) to achieve specific drilling objectives. Drilling fluids may also aid in maintaining hydrostatic pressure within the wellbore to prevent cave-ins or breakout events.

The term "non-Newtonian fluid" refers to a fluid wherein (1) the strain rate does not vary linearly with shear stress or (2) the yield stress is non-zero. A drilling fluid which follows a Herschel-Bulkley rheological profile is a combination of both whereas a Bingham-Plastic rheological profile is an example of the second kind with the shear stress varying linearly with strain rate. Furthermore, an addition of an agent (e.g., clay) can turn a Newtonian fluid (e.g., water, oil) into a non-Newtonian fluid.

The term "critical shear stress" refers to the shear stress exerted by a drilling fluid on the surface of a cuttings bed at which the cuttings begin to move. The critical shear stress is influenced by the properties of the particle (e.g., size, shape, density), particle size distribution on the bed surface and by the properties of the fluid (e.g., density, rheology), among other factors.

The term "surface shear stress" refers to the shear stress acting on the surface of a cuttings bed at a given time. The terms "bed shear stress" and "bed surface shear stress" may be used interchangeably with "surface shear stress" in the present disclosure.

The term "particle size distribution" or "PSD" refers to the mass fraction of different size particles on the surface of a cuttings bed.

The term "current PSD" refers to the particle size distribution on the surface of a cuttings bed at a given time.

The term "target PSD" refers to the particle size distribution on the surface of a cuttings bed, within an MD range, that improves cuttings transport at such MD range according to some aspects of the disclosure.

The term "pumping PSD" refers to the mass or volume flow rate of particles of each size that must be added to a wellbore to reach the target PSD in an MD range, according to some aspects of the present disclosure. The amount of particles of a given size that may need to be injected to reach the target PSD may exceed the difference between the target and the current amounts of such particle size to account for particles depositing prior to reaching the MD range of interest.

The term "particle transport model" refers to a model that predicts the fractional transport rate of particles for a given set of conditions such as, for example, particle bed composition, bed height, flow rate, and drilling fluid rheology, among others. The model may be empirical, semi-empirical, physics based or analytical, or numerical, or a combination thereof. Particle transport models include substrate-based transport models (also known as "bulk" models) and surface-based transport models.

The term "surface-based transport model" or "SBT model" refers to a particle transport model that utilizes the bed surface particle size distribution in predicting the transport rate of particles. This is different from a bulk or substrate-based model that predicts the transport rate of particles using the bed bulk particle size distribution, which could be less accurate because the surface size distribution and the bulk size distribution may be different due to particle sorting. Further, the fluid flow interacts primarily with the particles on the bed surface.

Aspects described herein provide a method to enhance cuttings transport and improve wellbore cleaning in drilling operations by adding solid particles of a specified size to a cuttings bed according to modeling framework incorporating a particle transport model. The particle transport model (which may be a bulk model or a surface-based transport (SBT) model) may be used to determine, based on critical shear stress and surface shear stresses on a cuttings bed, the optimum particle size distribution and mass rate of particles to be added to the flow to adjust critical shear stress to enhance cuttings transport. These particles may be added by injection into the drill string or by adjusting drilling operations to generate such particles during excavation with a drill bit.

Cuttings and Cavings

Referring to FIG. 1, a simplified diagram of a conventional drilling system is shown. The system may include a rig or derrick 100 which holds other drilling equipment. The system may further include a drill string 102 comprising sections of drill pipe such as 104 to transmit drilling fluid and torque to the drill bit 106. The drill string 102 is inserted into the wellbore 110, which in this illustration comprises a vertical portion and a non-vertical portion. The drill string 102 may comprise other components or parts not shown here for simplicity. It is understood that the drilling system contemplated herein may include equipment conventionally employed in wellbore drilling operations. Drilling fluid pumped down the drill pipe sections 104 and out of the drill bit 106 may flow out of the wellbore 110 through the annulus 108—i.e., the annular space between the rotating or non-rotating drill pipe section 104 and the borehole wall or casing/liner.

Figure 2:
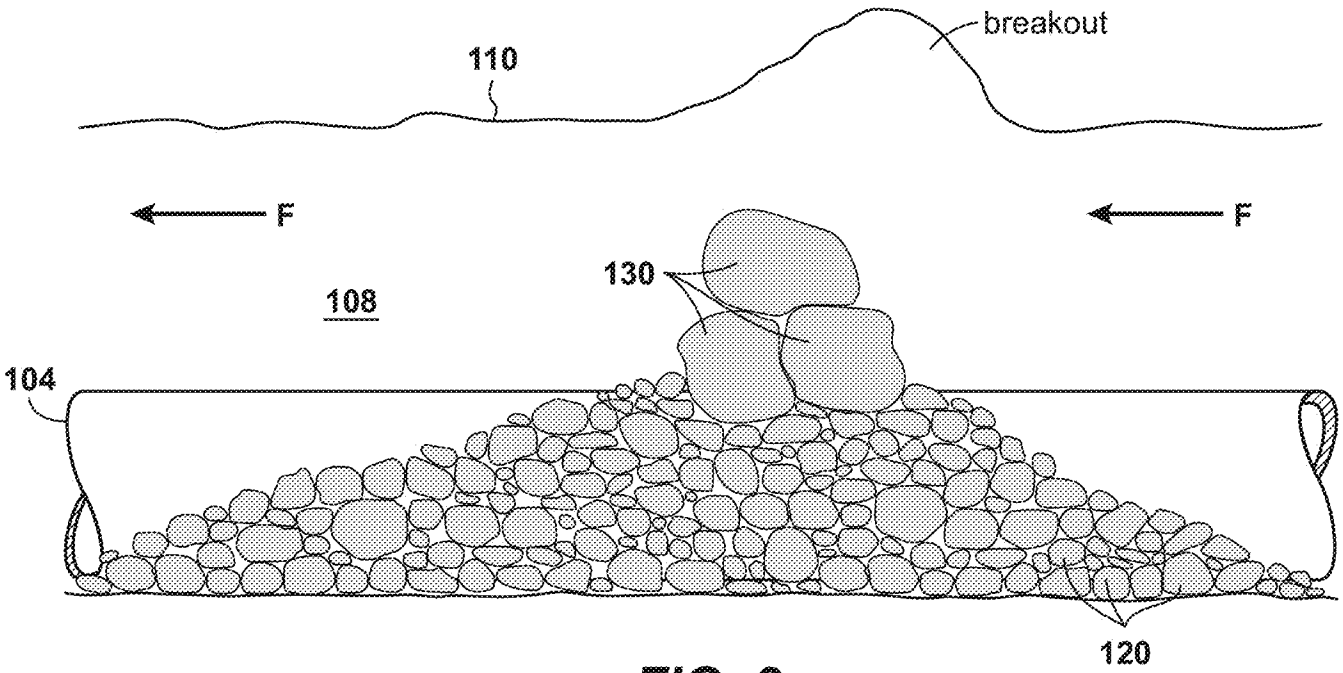
FIG. 2 is an exemplary section of the horizontal portion of the wellbore of FIG. 1 showing accumulation of cuttings below and around a portion of the drill pipe, and a breakout.

FIG. 2 illustrates an exemplary section of the horizontal portion of the wellbore 110 of FIG. 1 showing accumulation of cuttings below and around a portion of the drill pipe 104. The accumulation may form a cuttings bed 120 along a portion of the lower side of the annulus 108 formed by the borehole wall or casing/liner and the drill pipe 104. While drilling fluid may continue to flow along the annulus 108, the velocity and pressure of the fluid are necessarily affected by the variation in shape and size of the opening through which the fluid flows, as a result of the presence of the cuttings bed 120 or a change in size of the borehole due to a breakout. In particular, as the size of the cuttings bed 120 increases, the fluid velocity and shear stress on the cuttings bed 120 and wellbore walls increases because the volume flow rate of drilling fluid is typically maintained constant. As a result, the pressure may increase everywhere, including inside the drip pipe 104 and within the annulus 108, which can lead to a fracture of the wellbore 110. A wellbore fracture may result in loss of mud to the formation resulting in a lower annulus pressure downstream of the fracture. The lower pressure could lead to a borehole collapse (i.e., breakout) and generate cavings 130.

The flow dynamics of the drilling fluid is complex and highly dependent on the amount of cuttings and cavings present in the fluid, the geometry of the annulus 108 at various points within the wellbore 110, the properties of the fluid used, and operational parameters such as flow rate and RPM, among many other factors. The well path may also affect cuttings transport. Combined with factors affecting the stability of a wellbore such as stress, rock strength, drilling practices, etc., "breakout" or cave-in events often occur within the wellbore that may result in relatively large pieces of rock detaching from the borehole wall. As shown in FIG. 2, these "cavings" 130 may accumulate around cuttings beds and exacerbate cuttings transport problems. Cavings may be characterized as splintery, blocky, or plate-like, with the splintery cavings being a result of a less severe breakout event and the plate-like cavings most likely resulting from a more severe event. In the present disclosure, reference to a "cuttings bed" is intended to include instances of cavings present within the bed.

Cuttings Transport

Figure 3:
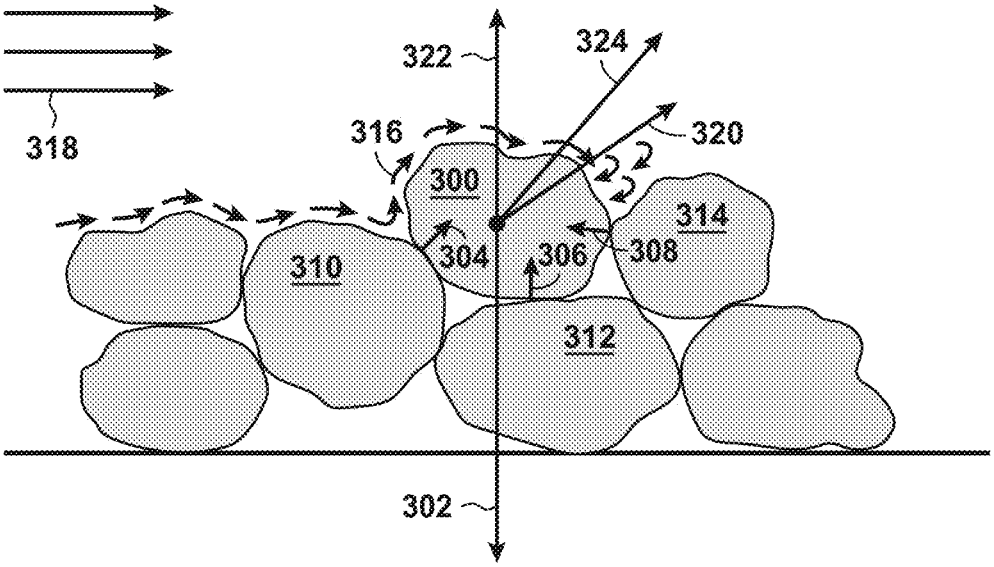
FIG. 3 is a simplified diagram of the main forces acting on an individual cuttings particle within a cuttings bed.

The mechanics and principles behind cuttings transport (term which is used herein to refer to transport of both cuttings and cavings) may be best understood by examining the various forces acting on cuttings and cavings as a result of fluid flow. Referring to FIG. 3, a simplified diagram of the main forces acting on an individual cuttings particle 300 within a cuttings bed is shown. The cuttings particle 300 may experience a weight force 302; normal forces 304, 306, 308 resulting from direct contact with neighboring cuttings particles 310, 312, 314, respectively; a drag force 316 exerted by the fluid flow 318; a lift force 320 due to turbulence; and a buoyancy force 322. All of these forces result in a total force 324. In general, bigger cuttings will have a larger surface area and therefore experience more drag force due to fluid flow above them, which in turn may cause the bigger cuttings to roll along the bed surface. On the other hand, bigger cuttings will be heavier with respect to particulate volume size and the turbulence and buoyancy forces may not suffice to lift the bigger cuttings into the fluid flow. In contrast, relatively smaller particles are typically easier transported in a fluid flow. Hence, generally, the primary mode of transport of larger cuttings from a drill bit may be rolling along the cuttings bed in the annular space. In contrast, smaller cuttings experience lower drag forces due to their smaller surface area, but being lighter they are more likely to get lifted into the flow and transported by bouncing or hopping along the surface—a phenomenon described as saltation. This is apparent when observing particle distribution along a river bed, demonstrating the heaviest particles falling our first and the lighter particles being transported for deposition further downstream until the velocity sufficiently subsides, resulting in depositional grading.

Figure 4:
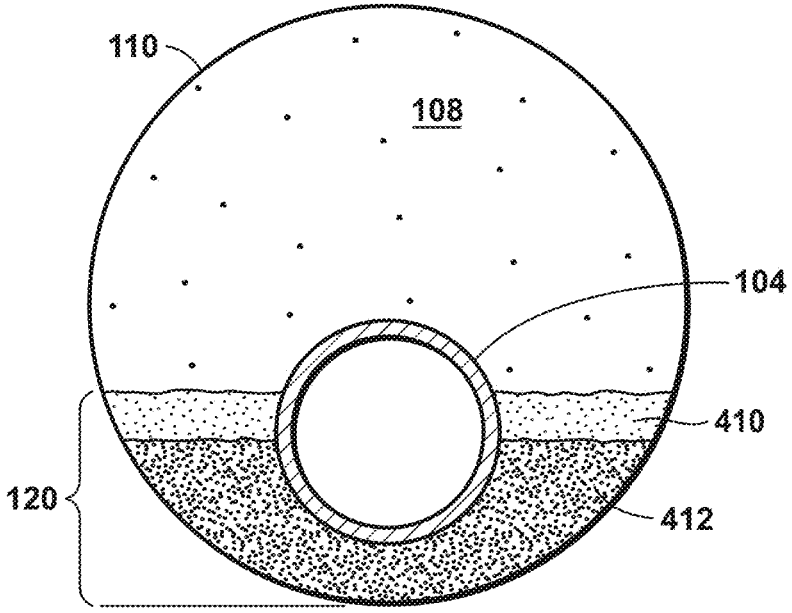
FIG. 4 illustrates an exemplary cross section of a cuttings bed around a section of drill pipe.

FIG. 4 illustrates an exemplary cross section of a cuttings bed 120 around a section of drill pipe 104. Due to the various particle sizes of the cuttings in the cuttings bed and the continuous fluid flow above the bed, two distinct sections tend to form within the cuttings bed 120: a moving bed portion or layer 410 and a stationary bed portion or layer 412. The moving bed layer 410 comprises the region of the cuttings bed 120 in which cuttings are relatively mobile and subject to the drag and friction forces from the fluid flow and drill pipe rotation.

The moving bed layer 410 can move along the borehole in the axial direction or in the circumferential direction during pipe rotation, or both. The stationary bed layer 412 is the region of the cuttings bed 120 where cuttings are relatively stationary and experience minimal friction and drag from the fluid flow above the moving bed layer 410. While the boundary between the moving bed layer 410 and stationary bed layer 412 may be continuously changing and have irregular profiles, the moving bed layer 410 may generally be comprised of a small fraction of cuttings relatively close to the surface of the cuttings bed 120, but contribute significantly to the cuttings transport rate in the annulus 108. Particles may further move in a suspended state within the fluid flowing in the annulus 108. In some embodiments of the present disclosure, the focus is on the transport near the bed surface—i.e., the moving bed layer 410 (also referred to as the bed load layer or moving layer). This is because the moving bed layer 410 is typically the predominant mode of cuttings transport for a wide range of operational parameters.

Figure 5A:
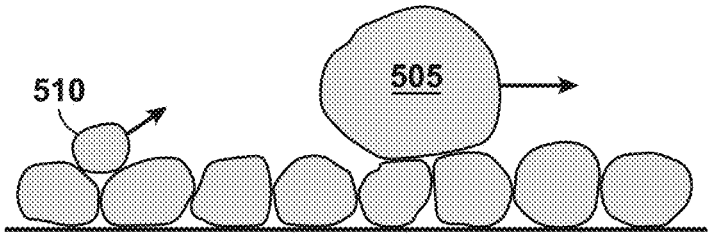
FIG. 5A is a simplified diagram illustrating the "rollability" effect.
Figure 5B:
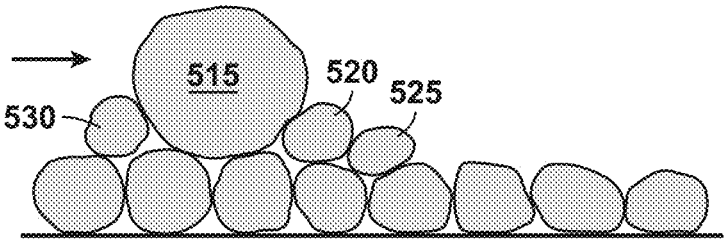
FIG. 5B is a simplified diagram illustrating the "hiding-sheltering" effect.

In addition, two basic principles related to relative particle size underlie cuttings transport. In particular, the "rollability" effect and the "hiding-sheltering" effect, as depicted in FIGS. 5A and 5B, respectively. As can be appreciated in FIG. 5A, a large particle 505 may experience less difficulty "rolling" over a bed of smaller particles compared to the difficulty a small particle 510 may experience rolling over a bed of particles that are relatively larger. This is known as the rollability effect." A related effect, the hiding-sheltering effect, also suggests larger particles like 515 may "shelter" smaller particles 520 and 525 from the flow as shown in FIG. 5B, or block particles like 530 from moving with the flow. Both principles must be taken into account in any particle transport modeling framework.

Methods disclosed herein for enhanced cuttings transport incorporate particle transport modeling of the cuttings transport mechanics. Such particle transport modeling may be based on a bulk approach or surface-based approach. The particle transport model may be incorporated into a framework designed to identify particles that are not being transported efficiently and determine how to change the local particle size distribution to improve those particles' transport. Any such particle transport model must accommodate the fact that the particle size distribution of a cuttings bed will continuously morph due to the continuous influx and outflow of particles.

According to some aspects of the present disclosure, two scenarios may be contemplated. In one scenario, larger particles may not be transported efficiently because they do not have an even surface to roll on. In this case, it is proposed that the addition of smaller particles may enhance the transport of the larger particles by creating a smoother surface to roll on. In another scenario, smaller particles may not be transported efficiently because the larger particles are blocking the smaller ones. In some embodiments, a proposed solution is to decrease the distribution of larger particles in the bed surface. This may be achieved by, for example, increasing their transport rate and clearing them off the bed surface within a depth range of interest by once again adding smaller particles of the appropriate size and concentration. Once the bigger particles clear off the bed surface, an improvement in the transport of the smaller particles may be observed.

Particle Transport Model

According to the above principles, a particle transport model for a bed of mixed size cuttings and cavings may be implemented within a larger hydraulics and hole cleaning framework based on the principle that the transport rate for particles of a given size is influenced by the bed composition. For example, such a particle transport model may be incorporated into a one-dimensional transient hydraulics solver of a discretized wellbore (described further below). The model may take into account local effects (e.g., fluid forces and friction forces) acting on each particle (cutting or caving) within a measured depth (MD) range of interest in the wellbore.

According to some aspects of the present disclosure, a properly formulated relation between fluid force and particle response may be applied across the entire range of drilling operational parameters to predict the transport of differently sized particles. To this end, a similarity collapse over fractional transport rate may be used (Wilcock 2003):

$$T^*_i = f(\tau/\tau_{ci}) \quad \text{(Eq. 1)}$$

where $\tau$ is the surface shear stress exerted on the bed surface due to the fluid flow, $\tau_{ci}$ is the critical shear stress (the shear stress at which particles of size fraction i begin to move), and $T^*_i$ is the dimensionless fractional transport rate. $T^*_i$ is made dimensionless as follows:

$$T_i^* = \frac{T_i}{\delta T_i} \quad \text{(Eq. 2)}$$

where $\delta T_i$ is a scale to make $T_i$ (fractional transport rate) dimensionless and may be a function of particle density, flow rate, fluid rheology, among other fluid and particle parameters as is known in the art.

Figure 6:
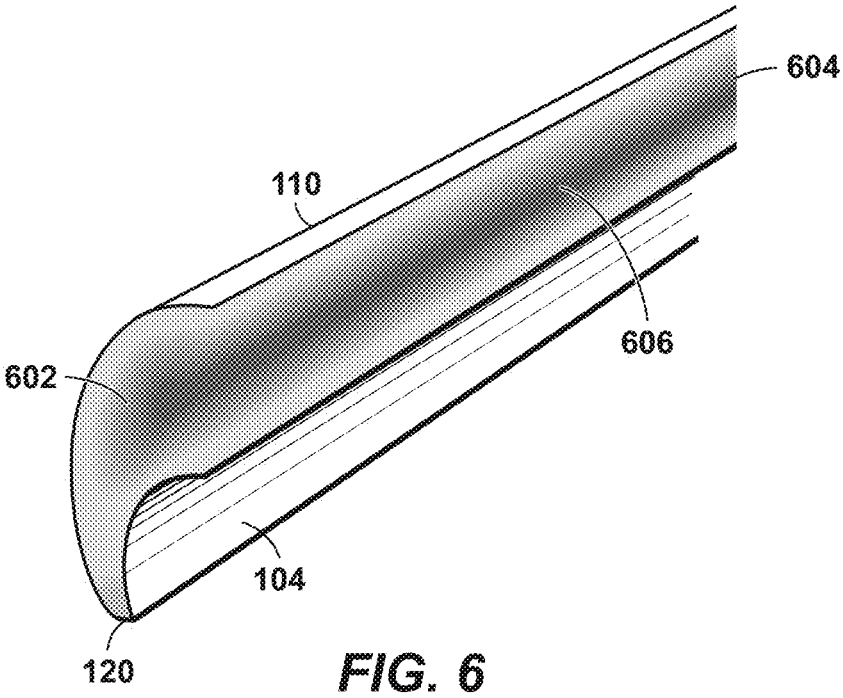
FIG. 6 is an exemplary CFD model and boundary conditions diagram.

The surface shear stress $\tau$ acting on the cuttings bed captures a number of variables relevant to cuttings transport such as the flow geometry, which depends on the annulus geometry and bed height, the particles on the bed surface (analogous to a bed surface roughness), the fluid flow rate, non-Newtonian rheology, and turbulence effects. In some embodiments, a commercial computational fluid dynamics (CFD) software package may be employed to determine a bed shear stress profile across the cuttings bed. For example, with reference to FIG. 6, boundary conditions in an exemplary CFD model are shown. The boundaries include the drill pipe 104, the wellbore or casing/liner 110, the surface of the cuttings bed 120, and two periodic inlet and outlet boundaries 602 and 604. This model assumes a symmetry boundary 606, no rotation, and only one half of the annulus is shown. (With rotation, the entire annulus would need to be modeled, perhaps even considering the inclusion of a multiphase model with particles to determine the bed shear stress.) The fluid in the CFD model is a single-phase fluid. CFD software is typically able to solve the Navier-Stokes equations with constitutive models (such as Herschel Bulkley, Power Law, Binghma Plastic) for the Non-Newtonian rheology and turbulence (k-epsilon, Spalart-Almaras, etc.) to arrive at a velocity field. The velocity field may in turn be used to calculate the bed shear stress $\tau$ acting on the cuttings bed 120. In yet other embodiments, an analytical model may be developed from the results of a CFD model or a solution may be obtained through a theoretical analysis.

Various models for $\tau_{ci}$ and $T^*_i$ exist in the context of substrate-based (i.e., bulk) transport modeling (e.g., Meyer-Peter and Muller 1948, Kuhnle 2013, the entirety of each incorporated herein by reference). Surface-based transport (SBT) models are fewer because the development of one requires coupled observations of flow, transport, and surface grain size, which in general can be challenging.

An example of an SBT model is provided in Wilcock (2003), which was developed in the context of a study of sediment transport conducted for environmental purposes. While it may be appropriate to use the Wilcock model within the framework described here because the model is based on bed surface characteristics, it should be noted that Wilcock's study was developed for transport of sediment (in particular, sand particles in the range of 0.5 mm-2 mm) which are more spherical than the cuttings and cavings contemplated herein. A correction or calibration parameter may be developed through additional experiments or field testing to account for this difference and for the non-Newtonian rheology of the drilling fluid as compared to water. As applicable to the present disclosure, the effects of drill pipe rotation may be captured by employing a similar modeling approach with the fluid shear stress being replaced by a wall shear stress due to pipe rotation or some similar method. The particle transport rate due to drill pipe rotation may be summed to the particle transport rate due to fluid flow along the pipe to capture the coupled effects.

In the Wilcock model, which is an example of an SBT model, a similarity collapse of the experimental data may be used to develop a model for the critical shear stress as follows:

$$\frac{\tau_{ci}}{\tau_{csm}} = \left(\frac{D_i}{D_{sm}}\right)^b \quad \text{(Eq. 3)}$$

where $D_i$ is the particle size of fraction i; $D_{sm}$ is the mean particle size on the bed surface; and $\tau_{csm}$ is the critical shear stress of mean particle size on the bed surface. The exponent is defined as:

$$b = \frac{0.67}{1 + \exp\left(1.5 - \frac{D_i}{D_{sm}}\right)} \quad \text{(Eq. 4)}$$

The critical shear stress of mean particle size $\tau_{csm}$ may be calculated using the following:

$$\tau_{csm} = (s-1)\mu g D_{sm}[0.021 + 0.015e^{-20F_s}] \quad \text{(Eq. 5)}$$

where $F_s$ is the particle content on the bed surface that is less than 2 mm in diameter (Wilcock 2003).

A similarity solution is also obtained for the transport rate as (Wilcock 2003):

$$T_i^* = \begin{cases} 0.002\left(\frac{\tau}{\tau_{ci}}\right)^{7.5} & \text{for } \phi < 1.35 \\ 14\left(1 - \frac{0.894}{\sqrt{\left(\frac{\tau}{\tau_{ci}}\right)}}\right)^{4.5} & \text{for } \phi \geq 1.35 \end{cases} \quad \text{(Eq. 6)}$$

Finally, the transport rate $T_i$ is made dimensional by:

$$T_i = F_i u_*^3 \{g(s-1)\} T^*_i \quad \text{(Eq. 7)}$$

In Eq. 7, $T_i$ is the dimensional volumetric transport rate per unit width for size fraction i; $F_i$ is the proportion of particles of size i on the bed surface; g is the acceleration due to gravity; s is the solid-to-liquid density ratio; and the shear velocity $u_*$ may be defined as $u_* = \sqrt{\tau/\rho}$ where $\rho$ is the mud density. The result of Eq. 7 may be multiplied by the width of the cuttings bed to determine the total volumetric fractional transport rate.

Thus, according to some aspects of the present disclosure, in surface-based model embodiments, once the surface shear stress $\tau$ and surface size distribution ($F_i$, $D_i$) are specified using the above model or any other SBT model, transport rates may be calculated as described above. For example, one may specify a desired fractional transport rate $T_i$ and calculate the target PSD in the MD range of interest using an inverse application of the SBT model using an iterative approach as described in Parker (1990) and Parker (1993), the entirety of each incorporated herein by reference. The desired fractional transport rate $T_i$ may be any rate that is an improvement over the current fractional transport rate $T_i$, which is based on the initial PSD and may be determined as described above.

It should be understood that other SBT models or combinations thereof are contemplated herein, and the models may be calibrated for cuttings and cavings as necessary. Non-limiting examples include the Canterbury model by Proffitt and Sutherland (1983) and the model developed by Parker (1990), the entirety of each incorporated herein by reference. In addition to the corrections described above with respect to the Wilcock model, differences between the frictional effects for particles and the pipe/hole walls, on one hand, and frictional effects between particles, on the other hand, may be addressed through appropriate corrections. Also, corrections to capture the effect of well inclination may be incorporated in the model, as well as any changes in shape due to fracture of the particles as they transport in the wellbore.

Enhanced Cuttings Transport Methods

In some embodiments, a particle transport model as described above may be incorporated into a modeling framework that involves discretization along a wellbore. For example, the particle transport model may be incorporated into a one-dimensional transient hydraulics solver of a discretized wellbore.

Figure 7:
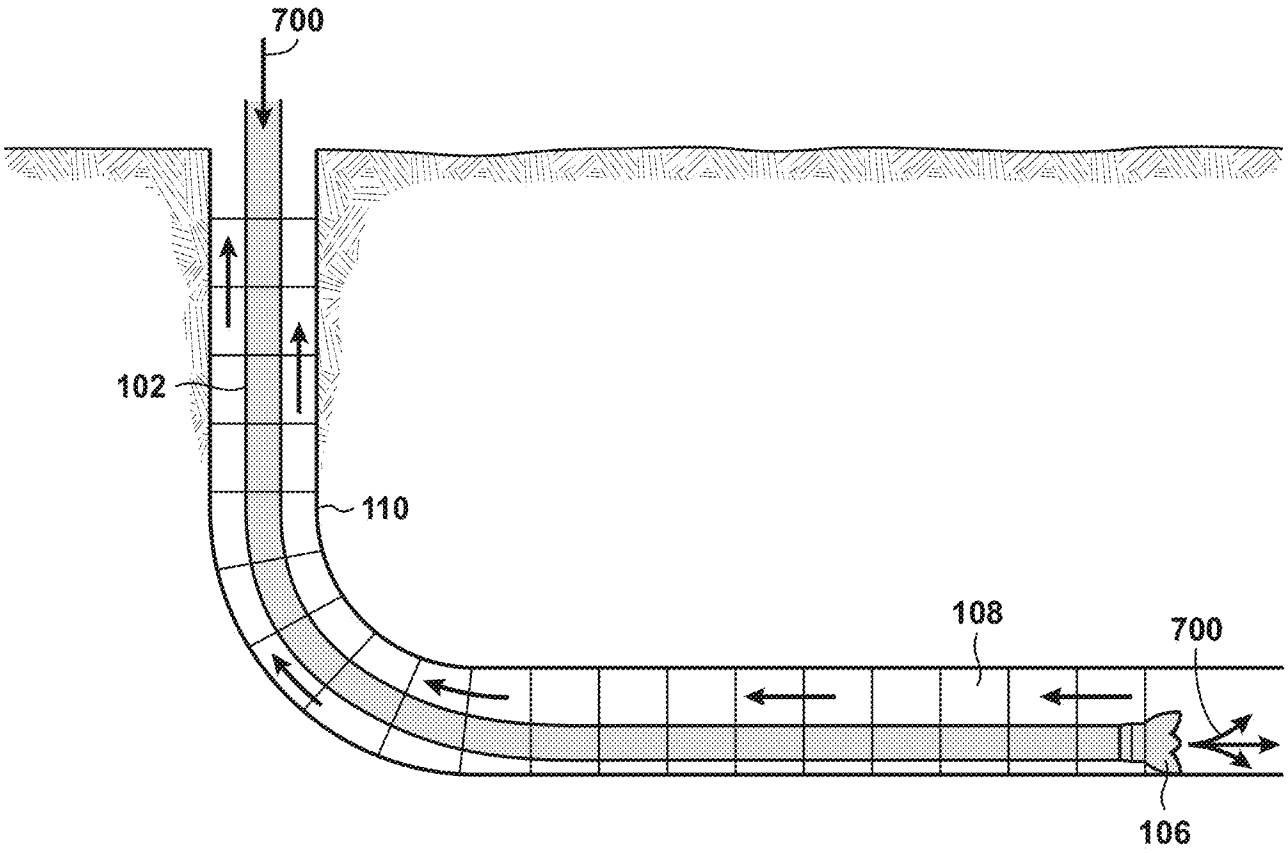
FIG. 7 is a simplified diagram of a discretized wellbore showing the discrete elements of a hydraulic solver.

FIG. 7 is simplified diagram of an exemplary discretized wellbore showing the discrete elements of a hydraulic solver. The drilling fluid 700 may enter the drill string 102 (which may be rotating) at the surface and exit at the drill bit 106, entering the annulus 108, perhaps together with any cuttings generated by the drill bit 106. The mud 700 and any cuttings may flow up the annulus 108 to the surface and exit the wellbore 110. The hydraulic solver may discretize the drill string 102 and annulus 108 into segments as shown, for purposes of analyzing the fluid flow and cuttings transport. For simplicity, the figure shows that the discrete element length is the same in the drill string and annulus. Optionally, the hydraulics solver may discretize the drill string 102 and annulus 108 with different element lengths. Further, the discrete element length may vary along the wellbore 110 in the drill string 102 and annulus 108. It should be understood that many variations exist in developing and implementing a hydraulic solver. The principles governing fluid flow, i.e., mass conservation, momentum conservation, and energy conservation, apply in each discrete section of the drill string 102 and annulus 108 together with any constitutive relations for particle transport.

Figure 8:
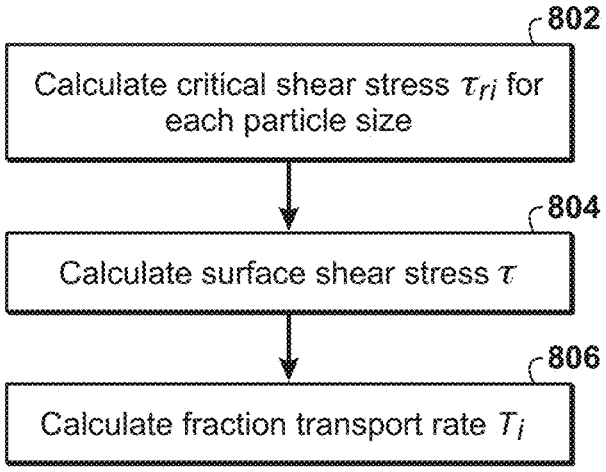
FIG. 8 is a flow diagram of a methodology for modeling cuttings transport within each discrete segment of an annulus of a discretized wellbore using a transport model.

According to some aspects of the present disclosure, modeling of the cuttings transport within the annulus of the discretized wellbore of FIG. 7 using a particle transport model may be implemented according to the methodology illustrated in FIG. 8. For each discrete element, at step 802, the critical shear stress $\tau_{ci}$ for each particle size may be calculated based on the current particle size distribution (PSD) on the surface of the cuttings bed. Next, at step 804, the surface shear stress $\tau$ acting on the surface of the bed may be calculated according to the processes described above. At step 806, the fractional transport rate $T_i$ may also be calculated as described elsewhere herein. This fractional transport rate may incorporate the transport due to the flow in an axial direction along the annulus and, optionally, the transport due to rotation of the drill string 102.

In some embodiments, the current PSD on the surface of the cuttings bed may be updated to reflect the transport rate out of the discrete element and the transport rate coming into the discrete element from an upstream element (i.e., difference between fractional transport rate in and fractional transport rate out). Accordingly, a particle transport model implemented in a discretization framework may be used to continuously calculate the current PSD in each discrete element along the annulus of the wellbore.

Estimating the cuttings component of the current PSD may be done by any means known in the art. For example, the cuttings component of the current PSD may be estimated using known data—typically available from drill bit manufacturers—regarding the particle size distributions expected when using specific drilling operating parameters such as depth of cut, RPM, and rock type among others. To estimate the cavings component of the current PSD, computational models for rock mechanics may be used. Specifically, known wellbore stability models may be employed to (1) predict at what MD range within a wellbore a breakout event may occur based on drilling conditions; (2) the volume of the breakout; (3) the characteristic length of the cavings the breakout will generate. The cuttings and cavings components constitute the current PSD for the specific MD range.

Figure 9:
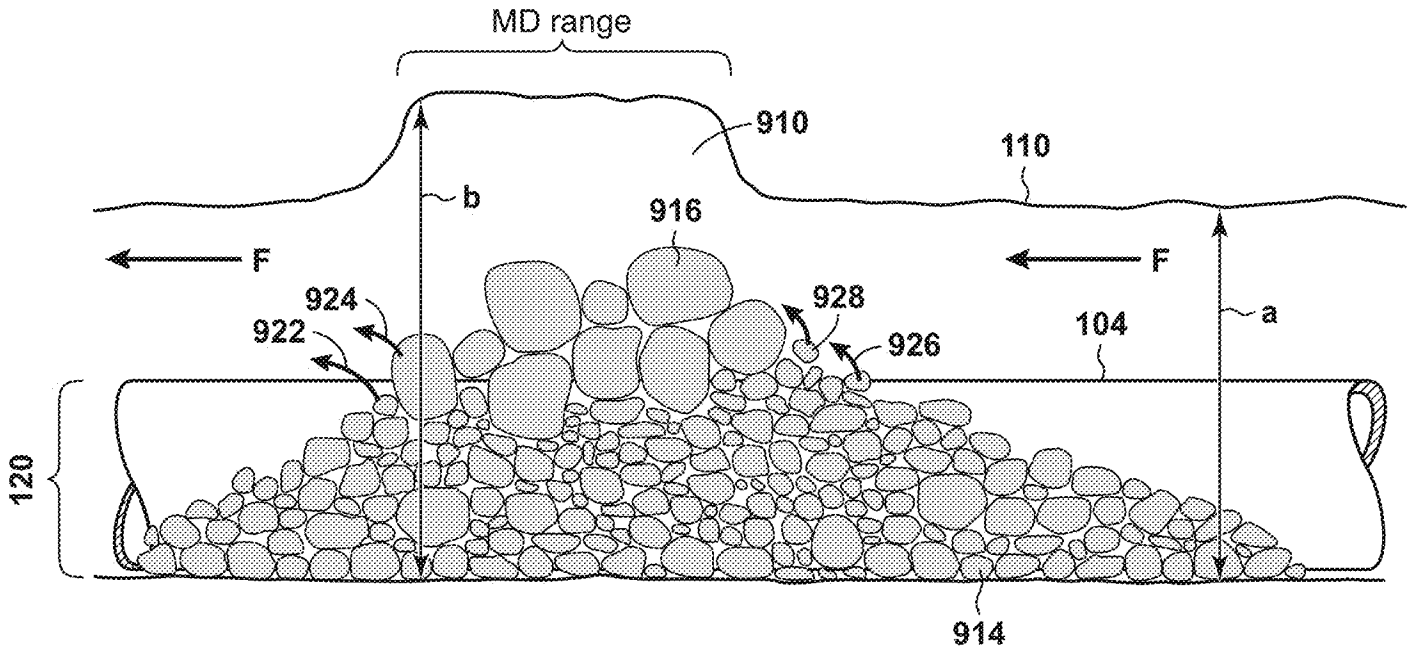
FIG. 9 a simplified diagram of a wellbore section showing a measured depth (MD) range having a breakout region and particles entering and leaving this region.

Within the framework described above, methods and systems disclosed herein may be applied to enhance cuttings transport and, in particular, transport of cavings, based on modifications of the cuttings and cavings PSD on the bed surface of a horizontal or semi-horizontal section of wellbore (i.e., the MD range of interest). For example, in some embodiments, the method may take into account the transport mechanisms illustrated in FIG. 9. Specifically, FIG. 9 represents a section of wellbore 110. The wellbore 110 may include a breakout region 910 corresponding to an MD range of interest. The breakout region 910 may have a diameter b that is larger than the average wellbore diameter a. Within the cuttings bed 120 surrounding drill pipe 104 there may be smaller cuttings (such as 914) deposited on the bottom surface of the wellbore 110 and larger cavings (such as 916) concentrated in the breakout region 910. Cuttings and cavings may be transported within the fluid flow represented by arrow F either "rolling" or by suspension. In this context, two types of transport rate may be considered. First, the transport rate "away" from the MD range of interest (TRA), which is the rate of transport for all particles leaving the MD range of interest (such as cutting 922 and caving 924). Second, the transport rate "into" the MD range of interest (TRI), which is the rate of transport for all particles entering the MD range of interest (such as cuttings 926 and 928).

Accordingly, at a given time, the PSD within a given MD range may be understood as a function of the TRA and TRI:

$$PSD(t)=f(TRA-TRI) \quad \text{(Eq. 8)}$$

where PSD(t) is the percentage area distribution of particles of size $D_i$ on the surface of a cuttings bed. In other words, the current PSD will depend on the transport rate into the MD range of interest and the transport rate out of the MD range of interest. Thus, the current PSD may vary with time.

Figure 10A:
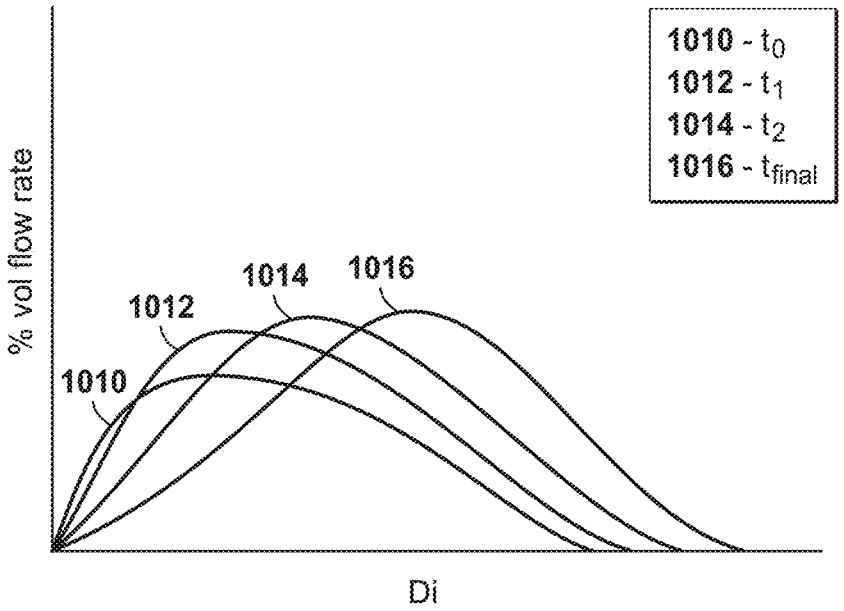
FIG. 10A is a plot showing an exemplary pumping PSD changing over time in order for the current PSD to achieve the target PSD.

According to some aspects of the present disclosure, using the current PSD as a starting point, cuttings transport within an MD range of interest may be enhanced by modifying the current PSD to achieve a target PSD that will facilitate transport of particles of a given size, e.g., cavings. Specifically, the current PSD may be modified by pumping or generating particles of a size that will help achieve the target PSD at the MD range of interest (i.e., by pumping or generating the pumping PSD). Because of the dynamic nature of the current PSD, the pumping PSD may change over time in order to accommodate changes to the current PSD as it evolves towards the target PSD. This is illustrated FIG. 10A. The rate of particles to be pumped or generated to achieve an exemplary target PSD may be represented by curve 1010 at time $t_1$, and evolve through curves 1012, 1014, and 1016 for times $t_2$, $t_3$, and $t_{final}$.

Figure 10B:
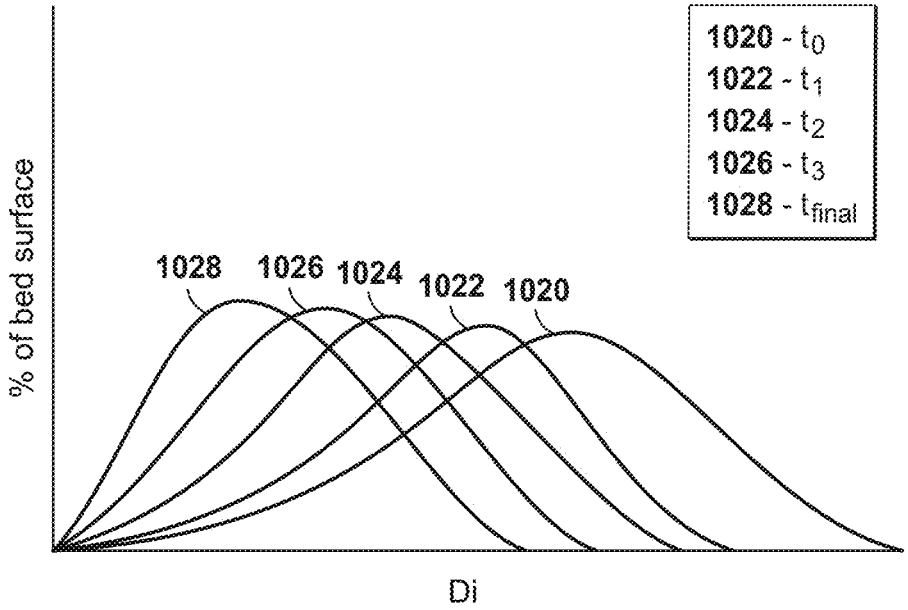
FIG. 10B is a plot showing an exemplary current PSD changing over time to reach a target PSD.

Accordingly, with reference to FIG. 10B, the current PSD within an MD range may evolve to the target PSD over time as shown. Specifically, curve 1020 represents the current PSD at a given time $t_0$. At times $t_1$, $t_2$, and $t_3$, the particle size distribution may progressively shift towards a smaller average particle diameter as illustrated by curves 1022, 1024, and 1026, respectively, to arrive at a target PSD at time $t_{final}$ represented by curve 1028. In some embodiments, the methods and systems described herein may also help determine the pumping/generating rate necessary to maintain the current PSD constant within the MD range of interest after achieving the target PSD.

In some embodiments, calculating the pumping PSD may be an iterative process. Specifically, one may start with a "test" pumping PSD. The test pumping PSD may be estimated using a modeling framework as described above (e.g., a one-dimensional transient hydraulics solver), or it may be estimated based on experience. Then, the framework may be used to also determine how the test pumping PSD affects the surface PSD of the bed in the MD range of interest. In other words, the framework is used to "test" the test pumping PSD to see if it improves transport of particles of interest of size $D_i$ (i.e., by achieving the target PSD). The test pumping PSD may be, in some embodiments, the amount of particles necessary to compensate for any deficit in the current PSD compared to the target PSD. In other embodiments, an extra amount of particles may be included to account for any expected losses between the injection or generation point and the MD range.

The test pumping PSD may then be used as an input of the modeling framework to see how it affects the current PSD. The resultant particle size distribution in the MD range—referred herein as the "result bed PSD"—may then be compared to the target PSD. If they match, the system may confirm that the test pumping PSD is indeed the necessary PSD to achieve the target PSD. Otherwise, if they do not match, the test pumping PSD may be adjusted. For example, if the result bed PSD is deficient compared to the target PSD with respect to particles of certain size, then the test pumping PSD may be modified to compensate for the deficit. If the result bed PSD has an excess of particles of a given size compared to the target PSD, those particles may be cleared out by applying the principles described above where their transport rate is increased by the addition of the appropriate (generally smaller) particles. This process may be repeated until the test pumping PSD generates a result bed PSD that matches the target PSD.

Once the pumping PSD is determined according to framework described herein incorporating a particle transport model, the particles may be added to the wellbore by any method. For example, such particles may be added to the drilling fluid being pumped down the wellbore. The particles may be rock obtained from the same wellbore or any other material suitable for mixing in the cuttings bed and withstanding movement within the drilling fluid, including for example glass beads, silica or graphite particles, etc. Alternatively, the particles may be generated by the operation of the drill bit. For example, data provided by drill bit manufacturers may be used to modify or adjust operating parameters to obtain the desired particles.

Figure 11:
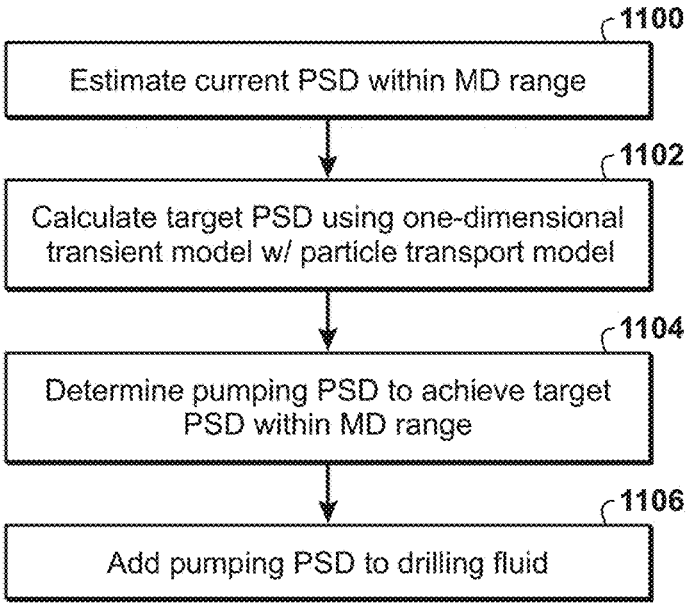
FIG. 11 is a flow chart showing steps of some methods described herein for enhancing cuttings transport.

According to aspects of the present disclosure, a method for enhancing cuttings transport in a cuttings bed within an annulus of a wellbore during drilling operations may be implemented as shown in FIG. 11. At step 1100, a current particle size distribution (PSD) of a particle bed within a measured (MD) range of the wellbore may be estimated. At step 1102, a target PSD may be calculated using a one-dimensional transient model incorporating a particle transport model (such as, in some embodiments, a surface-based transport model). At step 1104, a pumping PSD necessary to achieve the target PSD within the MD range may be determined using the one-dimensional transient model. Once the pumping PSD is known, it may be added to the drilling fluid at step 1106.

Estimating a current PSD at step 1100 may be done by using a one-dimensional transient model to predict a size distribution of cuttings in the MD range which is a result of transport of cuttings to the MD range, generated by the drill bit. The particle size distribution of cuttings generated depends on the kind of drilling bit used for the operation (e.g., roller cone, PDC, etc.). Further, the particle size distribution of cavings in the MD range may be predicted by any method known in the art, including without limitation, wellbore stability models, of which a breakout model is a further example. The cuttings and cavings size distributions in the MD range can together be used to estimate the current PSD. This may involve a calibration parameter for particle sorting or assume a well-mixed bed where the surface distribution is the same as the bulk distribution, an assumption that may be reasonable during drill pipe rotation. The one-dimensional transient model may employ a wellbore or casing or liner diameter, or combinations thereof, a flow rate of the drilling fluid, a rheology of the drilling fluid, and a cuttings bed height estimate, amongst others, as part of the calculation. These parameters may be estimated from hindcast data if the well is in a planning phase or may be obtained using caliper logs, rheology measurements, and rig surface equipment (e.g., pump) readings, if the well is in the execution phase. The cuttings bed height is difficult to measure in the field and may be estimated from the one-dimensional transient model.

Calculating a target PSD at step 1102 may be done by identifying the particle size $D_m$ whose transport needs to be enhanced based on the current PSD and predicted transport rates of the different size particles in the MD range. Then, one may assume a target PSD for the MD range that includes a particle of size $D_m$ whose transport needs to be enhanced. Using the one-dimensional transient model, a desired critical shear stress $\tau_{rmdesired}$ may be obtained for the particles of size $D_m$ within the MD range, as well as a surface shear stress $\tau$ on the particle bed in the MD range, and a current fractional transport rate $T_m$ for the particles of size $D_m$ within the MD range. Obtaining the current fractional transport rate $T_m$ may be done by calculating a critical shear stress $\tau_{cm}$ for the particles of size $D_m$ within the MD range; calculating a surface shear stress $\tau$ on the particle bed in the MD range; and using the particle transport model to calculate the current fractional transport rate $T_m$ for the particles of size $D_m$ within the MD range based on $\tau_{cm}$ and $\tau$. Then, one may compare $T_m$ to a desired fractional transport rate $T_{mdesired}$, and if $T_m$ and $T_{mdesired}$ are within a desired tolerance, the assumed target PSD may be adopted as the target PSD. Otherwise, if $T_m$ and $T_{mdesired}$ are not within the desired tolerance, the assumed target PSD may be modified and the foregoing steps repeated. The desired tolerance may be within a predetermined range, for example +/−50%, or +/−30%, or more preferably, +/−10%.

The above calculations may employ the borehole size and other drilling parameters such as wellbore or casing or liner diameter, or combinations thereof, a flow rate of the drilling fluid, a rheology of the drilling fluid, and a cuttings bed height estimate, amongst others. The assumed target PSD and modifications thereof may be based on any theory of mixed size particle transport, such as, for example, Wilcock's. In a physical sense, a goal may be to reduce the critical shear stress of the particles of size $D_m$ so as to increase their transport. In other words, the general interest may be to enhance the transport of particles whose size is larger than the mean particle size on the bed surface. If this is the case, the assumed target PSD may be obtained by increasing the number of particles whose size is smaller than the mean size. The intention behind this is to increase the rollability of the particles of size $D_m$.

Determining a pumping PSD at step 1104 may be done by assuming a pumping PSD; using the one-dimensional transient model to obtain a calculated PSD in the MD range of interest; comparing the calculated PSD to the target PSD; and if the calculated PSD and the target PSD are within a desired tolerance, one may adopt, as the pumping PSD, the assumed pumping PSD. Otherwise, if the calculated PSD and the target PSD are not within the desired tolerance, the assumed pumping PSD may be modified and the above steps repeated. The desired tolerance may be within a predetermined range, for example +/−50%, or +/−30%, or more preferably, +/−10%.

It should be understood that the pumping PSD refers to the mass or volume rate percentage, or concentration, or fractional portion of the different size particles being pumped into the drill string or generated by the drill bit at a given time. The above steps may be repeated for different times and for different MD ranges in order to ensure a continuous transport of the particles of size $D_m$ is obtained throughout the wellbore. Further, the one-dimensional transient model may be employed to study different scenarios to arrive at a suitable transient pumping PSD to achieve the goal of transporting the particles of size $D_m$ at a desired rate. An increase transport rate may be any desired increase, and may be only a few percentage increase or may be multiples of a current rate, such as for example, an increase in transport rate of at least 10%, or 25%, or 50%, or 100% (i.e., doubling the rate), or at least 200% increase, or at least 500% increase, or at least 1000% increase (e.g., if the particles are originally substantially immobile, then even a small increase in rate will results in an enormous percentage increase). The desired effect may be described in terms of an increase as compared to particles of other sizes so as to avoid calculations that produce an infinite increase in percentage rate. The underlying objective is merely to keep larger particles moving and not settling, so it is not necessary that particles achieve any particular velocity, but merely that they continue to adequately progress along the wellbore annulus and not settle into an undesirable bed accumulation. This technology merely teaches how to determine what fraction of smaller particles should be introduced to keep larger fractions of particles moving and not become compacted in a settling bed. The desired improvement or enhancement in transport rate is thereby merely an objective improvement, depending upon the wellbore size, fluid properties, wellbore tubular size, annulus cross-sectional area, hole irregularities, formation type, drilling fluid circulation rate, and similar factors and properties.

In some embodiments, the framework described above may be further calibrated using cuttings and cavings measurement data from the surface. The measurement data from the surface may include, in some embodiments, the transient (i.e., as a function of time) shape and size distribution of the cuttings and cavings, as well as the mass return rate of cuttings and cavings. This data can be used to calibrate a wellbore stability analysis model that predicts a breakout (i.e., hole size and PSD of cavings) and the particle transport model in numerical framework that predicts the fractional transport rate $T_i$ of cuttings and cavings along the wellbore annulus. One may verify if the cavings size measured at the surface matches predictions by the wellbore stability analysis model and if their arrival time at the surface matches the predictions by the particle transport model in the numerical framework. Furthermore, an inverse application of the particle transport model (in which the surface size distribution can be calculated if the transport rates are measured) may be employed in calibration of the wellbore stability analysis model or the particle transport model.

Due to the various transport mechanisms involved and the transport from one segment influencing the PSD and corresponding transport from the downstream segment, in some embodiments, one may run different scenarios before arriving at an optimum pumping PSD. In any event, using an appropriate particle transport model, embodiments contemplated herein accurately capture the transport of mixed cuttings and cavings while at the same time be computationally efficient and applicable to the entire wellbore. While numerical simulations have been considered in the past for cuttings transport, they become prohibitively expensive and in some cases unfeasible because of the large number of particles (for wellbore scale) and due to the multi-scale nature of the problem, i.e., the cavings could be as big as the annulus and be mixed together with cuttings that are an order of magnitude smaller.

Figure 12:
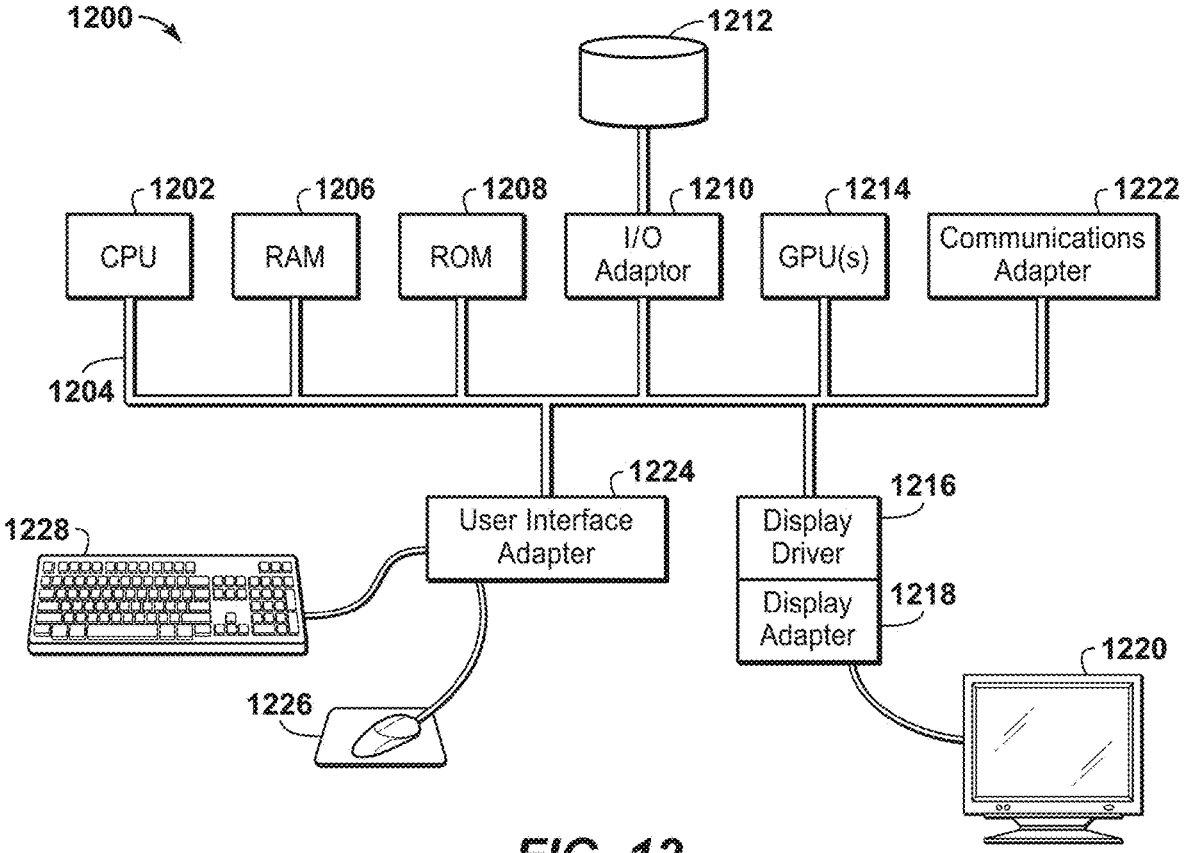
FIG. 12 is a diagram of an exemplary computer system that may be utilized to implement methods described herein.

Aspects of the present disclosure may be implemented using computer systems known in the art, such as systems commonly used in hydrocarbon management and data processing. In an exemplary computer system 1200 illustrated in FIG. 12, a central processing unit (CPU) 1202 is coupled to system bus 1204. The CPU 1202 may be any general purpose CPU, although other types of architectures of CPU 1202 (or other components of exemplary system 1200) may be used as long as CPU 1202 (and other components of system 1200) supports the operations as described herein. Those of ordinary skill in the art will appreciate that, while only a single CPU 1202 is shown in FIG. 12, additional CPUs may be present. Moreover, the computer system 1200 may comprise a networked, multi-processor computer system that may include a hybrid parallel CPU/GPU system. The CPU 1202 may execute various logical instructions according to various teachings disclosed herein. For example, the CPU 1202 may execute machine-level instructions for performing processing according to the operational flow described.

The computer system 1200 may also include computer components such as non-transitory, computer-readable media. Examples of computer-readable media include a random access memory (RAM) 1206, which may be SRAM, DRAM, SDRAM, or the like. The computer system 1200 may also include additional non-transitory, computer-readable media such as a read-only memory (ROM) 1208, which may be PROM, EPROM, EEPROM, or the like. RAM 1206 and ROM 1208 hold user and system data and programs, as is known in the art. The computer system 1200 may also include an input/output (I/O) adapter 1210, a graphics processing unit (GPU) 1214, a communications adapter 1222, a user interface adapter 1224, a display driver 1216, and a display adapter 1218.

The I/O adapter 1210 may connect additional non-transitory, computer-readable media such as a storage device(s) 1212, including, for example, a hard drive, a compact disc (CD) drive, a floppy disk drive, a tape drive, and the like to computer system 1200. The storage device(s) may be used when RAM 1206 is insufficient for the memory requirements associated with storing data for operations of the present techniques. The data storage of the computer system 1200 may be used for storing information and/or other data used or generated as disclosed herein. For example, storage device(s) 1212 may be used to store configuration information or additional plug-ins in accordance with the present techniques. Further, user interface adapter 1224 couples user input devices, such as a keyboard 1228, a pointing device 1226 and/or output devices to the computer system 1200. The display adapter 1218 is driven by the CPU 1202 to control the display on a display device 1220 to, for example, present information to the user regarding available plug-ins.

The architecture of system 1200 may be varied as desired. For example, any suitable processor-based device may be used, including without limitation personal computers, laptop computers, computer workstations, and multi-processor servers. Moreover, the present technological advancement may be implemented on application specific integrated circuits (ASICs) or very large scale integrated (VLSI) circuits. In fact, persons of ordinary skill in the art may use any number of suitable hardware structures capable of executing logical operations according to the present technological advancement. The term "processing circuit" encompasses a hardware processor (such as those found in the hardware devices noted above), ASICs, and VLSI circuits. Input data to the computer system 1200 may include various plug-ins and library files. Input data may additionally include configuration information.

Disclosed aspects may include any combinations of the methods and systems shown in the following numbered paragraphs. This is not to be considered a complete listing of all possible aspects, as any number of variations can be envisioned from the description above.

Embodiment Example 1

An exemplary method for enhancing transport rate of particles of size $D_m$ in a cuttings bed within an annulus of a wellbore during drilling operations, comprising: estimating, with a computer, a current particle size distribution (PSD) of a particle bed including particles of size $D_m$ within a measured depth (MD) range of the wellbore; calculating, with the computer, a target PSD of the MD range using a using a one-dimensional transient model incorporating a particle transport model; determining, with the computer, a pumping PSD to achieve the target PSD within the MD range; and adding the pumping PSD to a drilling fluid flowing within the annulus, thereby enhancing the transport rate of particles of size $D_m$ within the MD range.

Embodiment Example 2

The method of exemplary embodiment 1, wherein estimating a current PSD comprises using the one-dimensional transient model.

Embodiment Example 3

The method of exemplary embodiment 1, wherein calculating a target PSD comprises: assuming a target PSD for the MD range; using the one-dimensional transient model to obtain a desired critical shear stress $\tau_{cmdesired}$ for the particles of size $D_m$ within the MD range; obtain a surface shear stress $\tau$ on the particle bed in the MD range; and obtain a current fractional transport rate $T_m$ for the particles of size $D_m$ within the MD range; comparing $T_m$ to a desired fractional transport rate $T_{mdesired}$; and if $T_m$ and $T_{mdesired}$ are within a desired tolerance, adopting, as the target PSD, the assumed target PSD; or, if $T_m$ and $T_{mdesired}$ are not within the desired tolerance, modifying the assumed target PSD and repeating steps (b)-(d).

Embodiment Example 4

The method of exemplary embodiment 3, wherein the desired fractional transport rate $T_{mdesired}$ is determined based on the current fractional transport rate $T_m$ for the particles of size $D_m$ in the MD range.

Embodiment Example 5

The method of exemplary embodiment 3, wherein the desired fractional transport rate $T_{mdesired}$ is higher than the current fractional transport rate $T_m$.

Embodiment Example 6

The method of exemplary embodiment 3, wherein obtaining the current fractional transport rate $T_m$ is comprises: calculating a critical shear stress $\tau_{cm}$ for the particles of size $D_m$ within the MD range; calculating a surface shear stress $\tau$ on the particle bed in the MD range; and using the particle transport model to calculate the current fractional transport rate $T_m$ for the particles of size $D_m$ within the MD range based on $\tau_{cm}$ and $\tau$.

Embodiment Example 7

The method of exemplary embodiment 1, wherein determining a pumping PSD comprises: assuming a pumping PSD; using the one-dimensional transient model to obtain a calculated PSD in the MD range of interest; comparing the calculated PSD to the target PSD; and if the calculated PSD and the target PSD are within a desired tolerance, adopting, as the pumping PSD, the assumed pumping PSD; or, if the calculated PSD and the target PSD are not within desired tolerance, modifying the assumed pumping PSD and repeating steps (b)-(d).

Embodiment Example 8

The method of exemplary embodiment 1, wherein the particle transport model is a surface-based transport (SBT) model.

Embodiment Example 9

The method of exemplary embodiment 8, wherein the SBT model is based on the following solution for the dimensionless fractional particle transport rate $T^*_i$ of particles of size $D_i$:

$$T_i^* = \begin{cases} 0.002\left(\frac{\tau}{\tau_{ci}}\right)^{7.5} & \text{for } \phi < 1.35 \\ 14\left(1 - \frac{0.894}{\sqrt{\left(\frac{\tau}{\tau_{ci}}\right)}}\right)^{4.5} & \text{for } \phi \geq 1.35 \end{cases}$$

where $\tau$ is the bed shear stress of the particle bed, $\tau_{ci}$ is the critical shear stress of particles of size $D_i$:

Embodiment Example 10

The method of exemplary embodiment 1, wherein adding the pumping PSD to a drilling fluid flowing within the annulus comprises injecting the pumping PSD, generating the pumping PSD during drilling operations, or a combination thereof.

Embodiment Example 11

An exemplary method for enhancing transport rate of particles of size $D_m$ in a cuttings bed within an annulus of a wellbore during drilling operations, comprising: injecting a plurality of particles of size smaller than $D_m$ into the annulus, thereby enhancing the transport rate of particles of size $D_m$ within the wellbore.

Embodiment Example 12

An exemplary non-transitory computer usable medium having a computer readable program code embodied therein, said computer readable program code adapted to be executed by a computer to implement a method for enhancing transport rate of particles of size $D_m$ in a cuttings bed within an annulus of a wellbore during drilling operations, said method comprising: estimating, with the computer, a current particle size distribution (PSD) of a particle bed including particles of size $D_m$ within a measured depth (MD) range of the wellbore; calculating, with the computer, a target PSD of the MD range using a using a one-dimensional transient model incorporating a particle transport model; determining, with the computer, a pumping PSD to achieve the target PSD within the MD range; and adding the pumping PSD to a drilling fluid flowing within the annulus, thereby enhancing the transport rate of particles of size $D_m$ within the MD range.

Embodiment Example 13

The non-transitory computer usable medium of exemplary embodiment 12, wherein estimating a current PSD comprises using the one-dimensional transient model.

Embodiment Example 14

The non-transitory computer usable medium of exemplary embodiment 12, wherein calculating a target PSD comprises: assuming a target PSD for the MD range; using the one-dimensional transient model to obtain a desired critical shear stress $\tau_{cmdesired}$ for the particles of size $D_m$ within the MD range; obtain a surface shear stress $\tau$ on the particle bed in the MD range; and obtain a current fractional transport rate $T_m$ for the particles of size $D_m$ within the MD range; comparing $T_m$ to a desired fractional transport rate $T_{mdesired}$; and if $T_m$ and $T_{mdesired}$ are within a desired tolerance, adopting, as the target PSD, the assumed target PSD; or, if $T_m$ and $T_{mdesired}$ are not within the desired tolerance, modifying the assumed target PSD and repeating steps (b)-(d).

Embodiment Example 15

The non-transitory computer usable medium of exemplary embodiment 12, wherein the desired fractional transport rate $T_{mdesired}$ is determined based on the current fractional transport rate $T_m$ for the particles of size $D_m$ in the MD range.

Embodiment Example 16

The non-transitory computer usable medium of exemplary embodiment 12, wherein the desired fractional transport rate $T_{mdesired}$ is higher than the current fractional transport rate $T_m$.

Embodiment Example 17

The non-transitory computer usable medium of exemplary embodiment 12, wherein obtaining the current fractional transport rate $T_m$ comprises: calculating a critical shear stress $\tau_{cm}$ for the particles of size $D_m$ within the MD range; calculating a surface shear stress $\tau$ on the particle bed in the MD range; and using the particle transport model to calculate the current fractional transport rate $T_m$ for the particles of size $D_m$ within the MD range based on $\tau_{cm}$ and $\tau$.

Embodiment Example 18

The non-transitory computer usable medium of exemplary embodiment example 12, wherein determining a pumping PSD comprises: assuming a pumping PSD; using the one-dimensional transient model to obtain a calculated PSD in the MD range of interest; comparing the calculated PSD to the target PSD; and if the calculated PSD and the target PSD are within a desired tolerance, adopting, as the pumping PSD, the assumed pumping PSD; or, if the calculated PSD and the target PSD are not within desired tolerance, modifying the assumed pumping PSD and repeating steps (b)-(d).

Embodiment Example 19

The non-transitory computer usable medium of exemplary embodiment example 12, wherein the particle transport model is a surface-based transport (SBT) model.

Embodiment Example 20

The non-transitory computer usable medium of exemplary example 12, wherein the SBT model is based on the following solution for the fractional particle transport rate of particles of size $D_i$:

$$T_i^* = \begin{cases} 0.002\left(\frac{\tau}{\tau_{ci}}\right)^{7.5} & \text{for } \phi < 1.35 \\ 14\left(1 - \frac{0.894}{\sqrt{\left(\frac{\tau}{\tau_{ci}}\right)}}\right)^{4.5} & \text{for } \phi \geq 1.35 \end{cases}$$

where $\tau$ is the bed shear stress of the particle bed, $\tau_{ci}$ is the critical shear stress of particles of it) size $D_i$.

It should be understood that the numerous changes, modifications, and alternatives to the preceding disclosure can be made without departing from the scope of the disclosure. The preceding description and exemplary embodiments, therefore, are not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A method for enhancing transport of solid particles in a cuttings bed within a length of an annulus of a wellbore during drilling operations, comprising:

estimating a current particle size distribution (PSD) of a particle bed within a selected measured depth (MD) range along the length of the wellbore annulus, the PSD including particles of size $D_m$, the particles within the PSD of at least size $D_m$ targeted for enhanced transport;

calculating a target PSD of the MD range for enhanced transport of particles of at least size $D_m$ using a one-dimensional transient model incorporating a particle transport model;

determining, with a computer using the one-dimensional transient model, a pumping PSD to achieve the target PSD within the MD range; and adding the pumping PSD to the wellbore fluid flowing within the annulus, thereby enhancing the transport rate of particles of size $D_m$ within the MD range.

2. The method of claim 1, wherein estimating a current PSD comprises using the one-dimensional transient model.

3. The method of claim 1, wherein calculating a target PSD comprises:

(a) assuming a target PSD for the MD range;

(b) using the one-dimensional transient model to obtain a desired critical shear stress $\tau_{cmdesired}$ for the particles of size $D_m$ within the MD range; obtain a surface shear stress r on the particle bed in the MD range; and obtain a current fractional transport rate $T_m$ for the particles of size $D_m$ within the MD range;

(c) comparing $T_m$ to a desired fractional transport rate $T_{mdesired}$; and (d) if $T_m$ and $T_{mdesired}$ are within a desired tolerance, adopting, as the target PSD, the assumed target PSD; or, if $T_m$ and $T_{mdesired}$ are not within the desired tolerance, modifying the assumed target PSD and repeating steps (b)-(d).

4. The method of claim 3, wherein the desired fractional transport rate $T_{mdesired}$ is determined based on the current fractional transport rate $T_m$ for the particles of size $D_m$ in the MD range.

5. The method of claim 3, wherein the desired fractional transport rate $T_{mdesired}$ is higher than the current fractional transport rate $T_m$.

6. The method of claim 3, wherein obtaining the current fractional transport rate $T_m$ comprises:

calculating a critical shear stress $\tau_{cm}$ for the particles of size $D_m$ within the MD range;

calculating a surface shear stress $\tau$ on the particle bed in the MD range; and using the particle transport model to calculate the current fractional transport rate $T_m$ for the particles of size $D_m$ within the MD range based on $\tau_{cm}$ and $\tau$.

7. The method of claim 1, wherein determining a pumping PSD comprises:

(a) assuming a pumping PSD;

(b) using the one-dimensional transient model to obtain a calculated PSD in the MD range of interest;

(c) comparing the calculated PSD to the target PSD; and (d) if the calculated PSD and the target PSD are within a desired tolerance, adopting, as the pumping PSD, the assumed pumping PSD; or, if the calculated PSD and the target PSD are not within desired tolerance, modifying the assumed pumping PSD and repeating steps (b)-(d).

8. The method of claim 1, wherein the particle transport model is a surface-based transport (SBT) model.

9. The method of claim 8, wherein the SBT model is based on the following solution for the dimensionless fractional particle transport rate $T_i^*$ of size $D_i$:

$$T_i^* = \begin{cases} 0.002\left(\frac{\tau}{\tau_{ci}}\right)^{7.5} & \text{for } \phi < 1.35 \\ 14\left(1 - \frac{0.894}{\sqrt{\left(\frac{\tau}{\tau_{ci}}\right)}}\right)^{4.5} & \text{for } \phi \geq 1.35 \end{cases}$$

where $\tau$ is the bed shear stress of the particle bed, $\tau_{ci}$ is the critical shear stress of particles of size $D_i$.

10. The method of claim 1, wherein adding the pumping PSD to a drilling fluid flowing within the annulus comprises injecting the pumping PSD, generating the pumping PSD during drilling operations, or a combination thereof.

11. A method for enhancing transport rate of particles in a cuttings bed within an annulus of a wellbore during drilling operations, comprising:

determining an existing particle size distribution profile within the cuttings bed and a transport rate profile of the particles within the particle size distribution profile;

selecting a minimum targeted particle size $D_m$ of a fraction of the particles of size equal to or greater than a minimum particle size within the determined particle size distribution profile in the cuttings bed, to be targeted for enhanced transport rate within the annulus;

determining an improved particle size distribution using a one-dimensional transient model incorporating a particle transport model that produces the enhanced transport rate for the fraction of particles of size equal to or greater than the minimum particle size, the improved particle size distribution including an increased portion of particles of size not greater than the selected minimum targeted particle size $D_m$ as compared to the determined existing particle size distribution profile;

determining the differential concentration of particles with in the cuttings bed between the increased portion of particles of size not greater than the selected minimum targeted particle size $D_m$ and the determined existing particle size distribution; and introducing into the annulus of the wellbore from a wellbore tubular string positioned within the wellbore a determined rate of particles of size smaller than the selected $D_m$ to affect the desired enhanced transport rate in the wellbore annulus for the fraction of particles of size equal to or greater than the minimum particle size, wherein the determined rate is determined using the one-dimensional transient model.

12. A non-transitory computer usable medium having a computer readable program code embodied therein, said computer readable program code adapted to be executed by a computer to implement a method for enhancing transport rate of particles of size $D_m$ in a cuttings bed within an annulus of a wellbore during drilling operations, said method comprising:

estimating, with the computer, a current particle size distribution (PSD) of a particle bed including particles of size $D_m$ within a measured depth (MD) range of the wellbore;

calculating, with the computer, a target PSD of the MD range using a one-dimensional transient model incorporating a particle transport model;

determining, with the computer, using the one-dimensional transient model, a pumping PSD to achieve the target PSD within the MD range; and adding the pumping PSD to a drilling fluid flowing within the annulus, thereby enhancing the transport rate of particles of size $D_m$ within the MD range.

13. The non-transitory computer usable medium of claim 12, wherein estimating a current PSD comprises using the one-dimensional transient model.

14. The non-transitory computer usable medium of claim 12, wherein calculating a target PSD comprises:

(a) assuming a target PSD for the MD range;

(b) using the one-dimensional transient model to obtain a desired critical shear stress $\tau_{cmdesired}$ for the particles of size $D_m$ within the MD range; obtain a surface shear stress $\tau$ on the particle bed in the MD range; and obtain a current fractional transport rate $T_m$ for the particles of size $D_m$ within the MD range;

(c) comparing $T_m$ to a desired fractional transport rate $T_{mdesired}$; and (d) if $T_m$ and $T_{mdesired}$ are within a desired tolerance, adopting, as the target PSD, the assumed target PSD; or, if $T_m$ and $T_{mdesired}$ are not within the desired tolerance, modifying the assumed target PSD and repeating steps (b)-(d).

15. The non-transitory computer usable medium of claim 12, wherein the desired fractional transport rate $T_{mdesired}$ is determined based on the current fractional transport rate $T_m$ for the particles of size $D_m$ in the MD range.

16. The non-transitory computer usable medium of claim 12, wherein the desired fractional transport rate $T_{mdesired}$ is higher than the current fractional transport rate $T_m$.

17. The non-transitory computer usable medium of claim 12, wherein obtaining the current fractional transport rate $T_m$ comprises:

calculating a critical shear stress $\tau_{cm}$ for the particles of size $D_m$ within the MD range;

calculating a surface shear stress $\tau$ on the particle bed in the MD range; and using the particle transport model to calculate the current fractional transport rate $T_m$ for the particles of size $D_m$ within the MD range based on $\tau_{cm}$ and $\tau$.

18. The non-transitory computer usable medium of claim 12, wherein determining a pumping PSD comprises:

(a) assuming a pumping PSD;

(b) using the one-dimensional transient model to obtain a calculated PSD in the MD range of interest;

(c) comparing the calculated PSD to the target PSD; and (d) if the calculated PSD and the target PSD are within a desired tolerance, adopting, as the pumping PSD, the assumed pumping PSD; or, if the calculated PSD and the target PSD are not within desired tolerance, modifying the assumed pumping PSD and repeating steps (b)-(d).

19. The non-transitory computer usable medium of claim 12, wherein the particle transport model is a surface-based transport (SBT) model.

20. The non-transitory computer usable medium of claim 12, wherein the SBT model is based on the following solution for the fractional particle transport rate of particles of size $D_i$:

$$T_i^* = \begin{cases} 0.002\left(\frac{\tau}{\tau_{ci}}\right)^{7.5} & \text{for } \phi < 1.35 \\ 14\left(1 - \frac{0.894}{\sqrt{\left(\frac{\tau}{\tau_{ci}}\right)}}\right)^{4.5} & \text{for } \phi \geq 1.35 \end{cases}$$

where $\tau$ is the bed shear stress of the particle bed, $\tau_{ci}$ is the critical shear stress of particles of size $D_i$.

* * * * *